US008464624B2

(12) United States Patent
Asahina et al.

(10) Patent No.: US 8,464,624 B2
(45) Date of Patent: Jun. 18, 2013

(54) BLAST TREATMENT METHOD AND BLAST TREATMENT DEVICE

(75) Inventors: Kiyoshi Asahina, Kobe (JP); Kenji Koide, Kobe (JP); Takashi Gotou, Kobe (JP); Hideaki Shimoda, Kobe (JP); Ryusuke Kitamura, Kobe (JP); Nakaba Tsutsui, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 103 days.

(21) Appl. No.: 13/262,448

(22) PCT Filed: Mar. 24, 2010

(86) PCT No.: PCT/JP2010/002069

§ 371 (c)(1),
(2), (4) Date: Sep. 30, 2011

(87) PCT Pub. No.: WO2010/113429

PCT Pub. Date: Oct. 7, 2010

(65) Prior Publication Data

US 2012/0017753 A1 Jan. 26, 2012

(30) Foreign Application Priority Data

Mar. 31, 2009 (JP) ..... 2009-084664

(51) Int. Cl.
*F42B 33/00* (2006.01)

(52) U.S. Cl.
USPC ..... 86/50; 588/403

(58) Field of Classification Search
USPC ..... 86/50; 588/403, 401, 249.5
See application file for complete search history.

(56) References Cited

U.S. PATENT DOCUMENTS

| | | | | |
|---|---|---|---|---|
| 7,073,424 | B2 * | 7/2006 | Ferrari et al. | 86/50 |
| 7,398,720 | B2 * | 7/2008 | Fujiwara et al. | 86/50 |
| 8,006,600 | B2 | 8/2011 | Fujiwara et al. | |
| 2009/0131733 | A1 | 5/2009 | Asahina et al. | |

FOREIGN PATENT DOCUMENTS

| | | |
|---|---|---|
| JP | 2003 71414 | 3/2003 |
| JP | 2005 291514 | 10/2005 |

(Continued)

OTHER PUBLICATIONS

International Search Report Issued Jul. 13, 2010 in PCT/JP10/002069 filed Mar. 24, 2010.

(Continued)

*Primary Examiner* — Michael Carone
*Assistant Examiner* — Reginald Tillman, Jr.
(74) *Attorney, Agent, or Firm* — Oblon, Spivak, McClelland, Maier & Neustadt, L.L.P.

(57) ABSTRACT

A blast treatment method and an apparatus, which can perform the blast treatment of a treatment subject by using and securely initiating a blasting explosive having fluidity. The blast treatment method includes: a blasting preparation operation of housing a blasting explosive having fluidity in a container and placing the blasting explosive around a treatment subject as well as attaching an initiation device to the container; a housing operation of housing the container, the blasting explosive, and the treatment subject in a chamber; a decompression operation of decompressing the inside of the chamber; and a blasting operation of initiating the blasting explosive and blasting the treatment subject with the blasting explosive. In the decompression operation, the inside of the chamber is decompressed while a gas vent portion regulates the escape of the blasting explosive to the outside of the container and permits the escape of gases in the container to the outside.

13 Claims, 7 Drawing Sheets

FOREIGN PATENT DOCUMENTS

| | | |
|---|---|---|
| JP | 2007 271136 | 10/2007 |
| JP | 2007 309550 | 11/2007 |
| JP | 2008 14595 | 1/2008 |

OTHER PUBLICATIONS

U.S. Appl. No. 13/262,070, filed Sep. 29, 2011, Koide, et al.
U.S. Appl. No. 13/262,055, filed Sep. 29, 2011, Koide, et al.
U.S. Appl. No. 13/262,419, filed Sep. 30, 2011, Koide, et al.
U.S. Appl. No. 13/262,028, filed Sep. 29, 2011, Koide, et al.
U.S. Appl. No. 13/262,245, filed Sep. 30, 2011, Koide, et al.
Translation of the International Preliminary Report on Patentability with Written Opinion issued Nov. 24, 2011, in PCT Application No. PCT/JP2010/002069.

* cited by examiner

BLAST TREATMENT METHOD AND BLAST TREATMENT DEVICE

TECHNICAL FIELD

The present invention relates to a blast treatment method and an apparatus for carrying out the blast treatment of a military ammunition and the like.

BACKGROUND ART

The military ammunition (artillery shells, bombs, land mines, naval mines, and the like) are provided with bursting charges in shells made of steel and the like, for example.

The ammunition is treated by blasting, for example. The treatment method by the blasting does not need dismantling operations. Therefore, it is possible to treat ammunition and the like, which have become difficult to be dismantled due to deterioration over time, deformation, and the like in addition to ammunition and the like, which are in a good state of preservation. When a bomb having chemical agents hazardous to a human body is treated by this treatment method, almost all the chemical agents are decomposed in an ultra-high temperature and an ultra-high pressure field generated by an explosion. An example of such blast treatment is disclosed in Patent Document 1, for example.

In a method disclosed in Patent Document 1, a treatment subject and an ANFO explosive are housed in a container, a sheet-shaped explosive and an initiation device are attached to the outside of the container, and the container is housed in a chamber. After the inside of the chamber is decompressed in a sealed state, the sheet-shaped explosive is initiated. The explosive energy of the initiated sheet-shaped explosive detonates the ANFO explosive. The explosive energy of the ANFO explosive detonates the treatment subject while detonating a bursting charge and the like, which are provided for the treatment subject.

Patent Document 1: Japanese Patent Application Laid-Open No. 2005-291514

SUMMARY OF THE INVENTION

The treatment subjects have various shapes. It is preferable that a blasting explosive have fluidity in order to place the explosive around the periphery of the treatment subject regardless of the shape of the treatment subject. However, gases are mixed in an explosive having fluidity. Consequently, when the inside of the chamber is decompressed in a state where the explosive is sealed in the container, the pressure inside the container becomes relatively high in comparison with the pressure inside the chamber, and the container may expand and deform. The deformation of the container may move the position of the initiation device attached to the container and hamper the initiation of the explosive.

Accordingly, an object of the present invention is to provide a blast treatment method capable of carrying out the blast treatment of a treatment subject by securely initiating a blasting explosive having fluidity. In order to achieve the object, a blast treatment method of the present invention is a method for carrying out the blast treatment of a treatment subject, including: a blasting preparation step of housing a blasting explosive having fluidity in a container and placing the blasting explosive around the periphery of the treatment subject as well as attaching a initiation device to the container; a housing step of housing the container, the blasting explosive, and the treatment subject in a chamber; a decompression step of decompressing the inside of the chamber in a state where the chamber is sealed after the housing step; and a blasting step of initiating the blasting explosive by the initiation device and blasting the treatment subject by the blasting explosive, wherein the blasting preparation step includes the steps of: providing the container with a gas vent portion that regulates the escape of the blasting explosive from the container while permitting the escape of gases in the container; and hermetically sealing parts except the gas vent portion of the container, and in the decompression step, the inside of the container is decompressed through the gas vent portion while the inside of the chamber is decompressed.

This method controls an expansion of the container and a move of the position of the initiation device following the expansion upon decompressing the inside of the chamber. Hence, the blast treatment of the treatment subject with the fluid blasting explosive in the chamber that is sealed and whose inside is decompressed becomes more secure. This realizes more secure treatment of the treatment subject while facilitating the placement of the blasting explosive around the periphery of the treatment subject as well as making the environmental impacts of sound, vibration, and the like upon blasting excellent.

EMBODIMENTS FOR CARRYING OUT THE INVENTION

A description will hereinafter be given of a first embodiment of a blast treatment method according to the present invention with reference to drawings.

Figure 1:
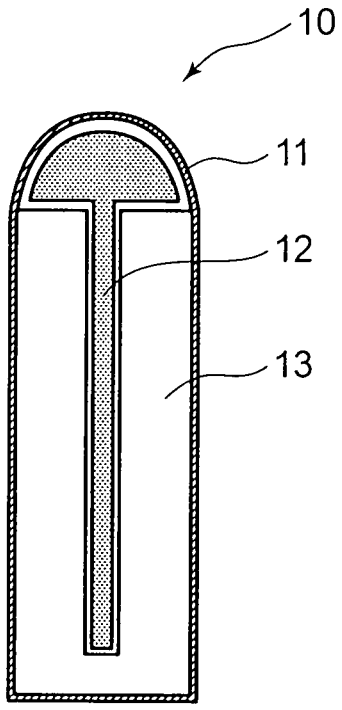
FIG. 1 is a cross-sectional view showing a treatment subject which receives blast treatment by a blast treatment method according to the present invention.

FIG. 1 is a cross-sectional view of a chemical bomb (a treatment subject) 10 treated by a blast treatment method according to the first embodiment. The chemical bomb 10 has a shape extending in the axis direction. The chemical bomb 10 has a bomb shell 11 made of steel, a bursting charge 12, and a chemical agent 13. The bursting charge 12 and the chemical agent 13 are housed inside the bomb shell 11. The bursting charge 12 is made of picric acid or TNT.

Figure 2:
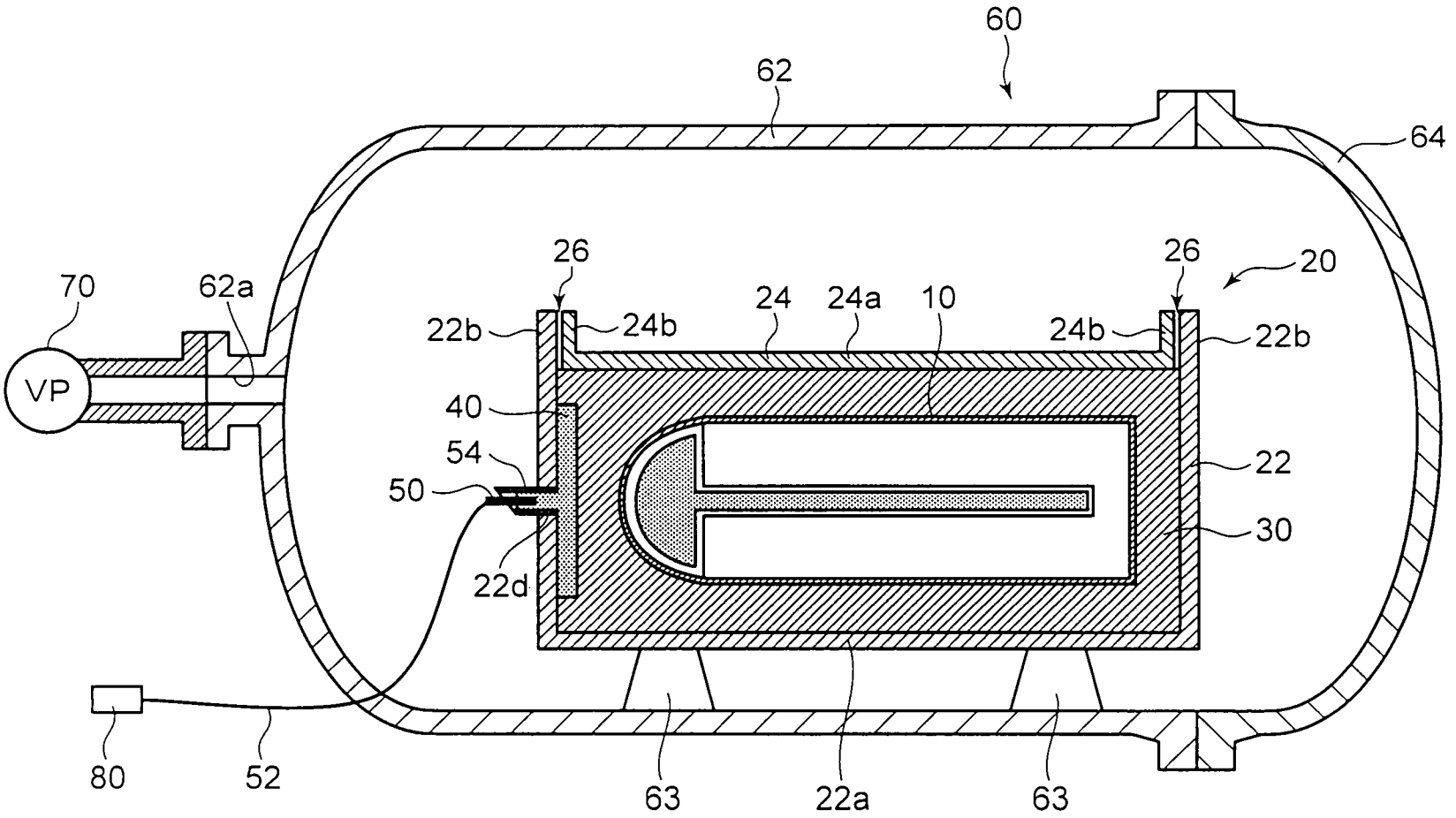
FIG. 2 is a transverse cross-sectional view of a blast treatment device used in the blast treatment method according to a first embodiment of the present invention.

In the first embodiment, the blast treatment of the chemical bomb 10 is carried out by using a blast treatment device 1 shown in FIG. 2. The blast treatment device 1 includes a container 20, a blasting explosive 30, a booster explosive 40, a detonator (initiation device) 50, a chamber 60 and a vacuum pump (decompression device) 70.

The blasting explosive 30 is for blasting the chemical bomb 10. The blasting explosive 30 has fluidity similarly to powder and fluid. Specifically, the blasting explosive 30 is any one of an emulsion explosive and a slurry explosive. Especially, an emulsion explosive is relatively inexpensive and has good performance. Therefore, if the blasting explosive 30 is an emulsion explosive, the cost of blast treatment becomes low.

The booster explosive 40 is for initiating the blasting explosive 30. The booster explosive 40 is an explosive having higher sensitivity to initiation than the blasting explosive 30. For example, the booster explosive 40 contains any one of PETN and RDX as a main ingredient. Any one of PETN and RDX has higher sensitivity to initiation than the emulsion explosive and the slurry explosive.

Figure 3:
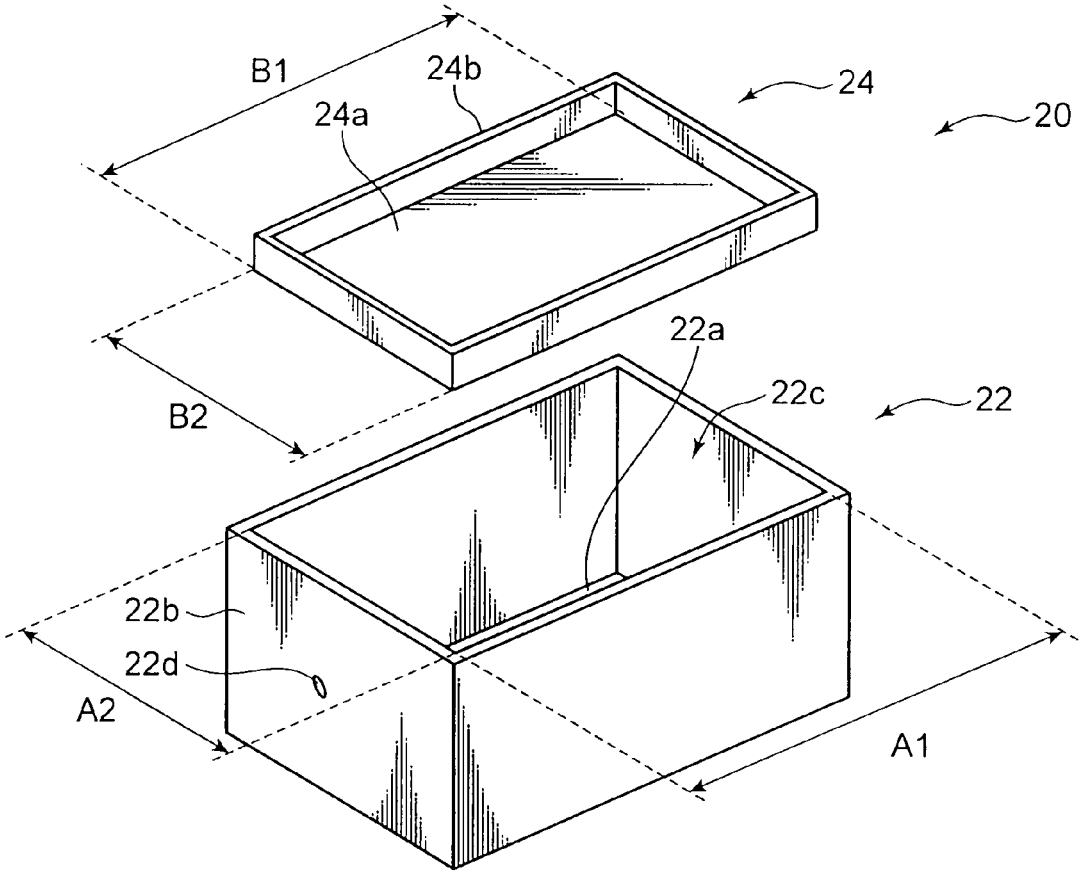
FIG. 3 is a schematic exploded view of a container used for the blast treatment device shown in FIG. 2.
Figure 4:
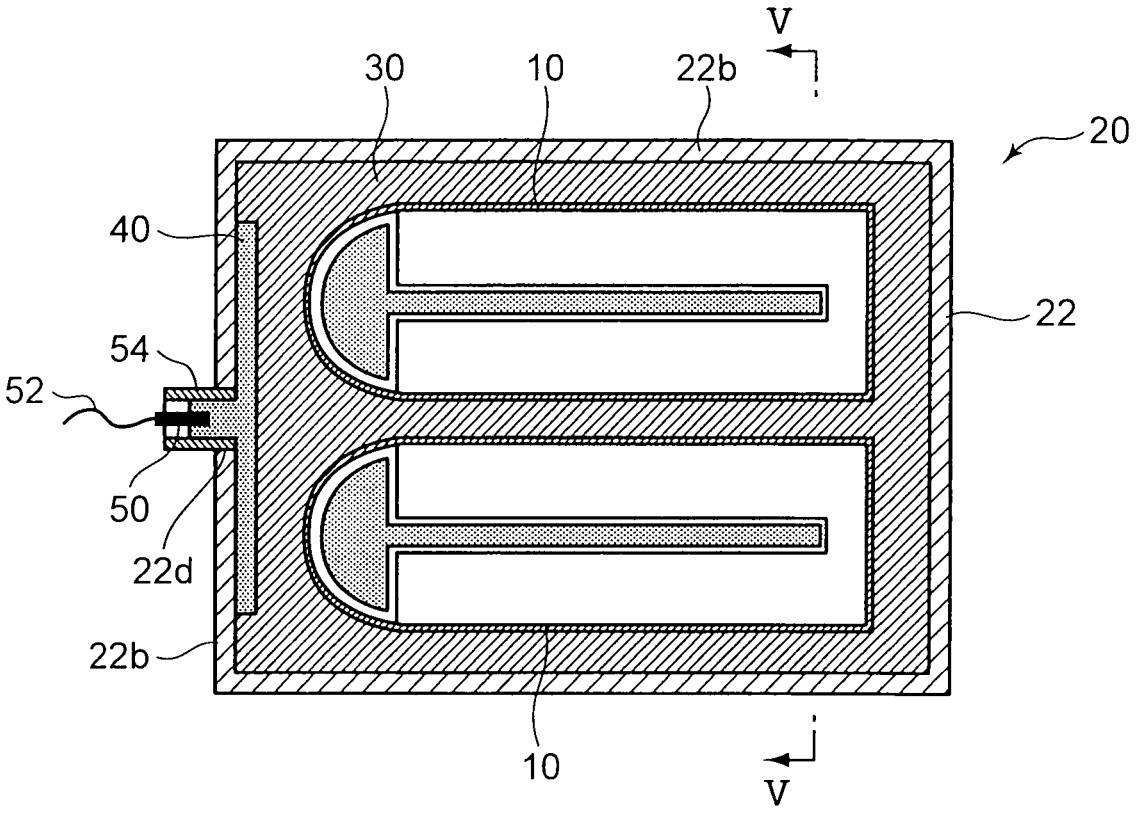
FIG. 4 is a cross-sectional view showing a state where the treatment subject is housed in the container shown in FIG. 3.
Figure 5:
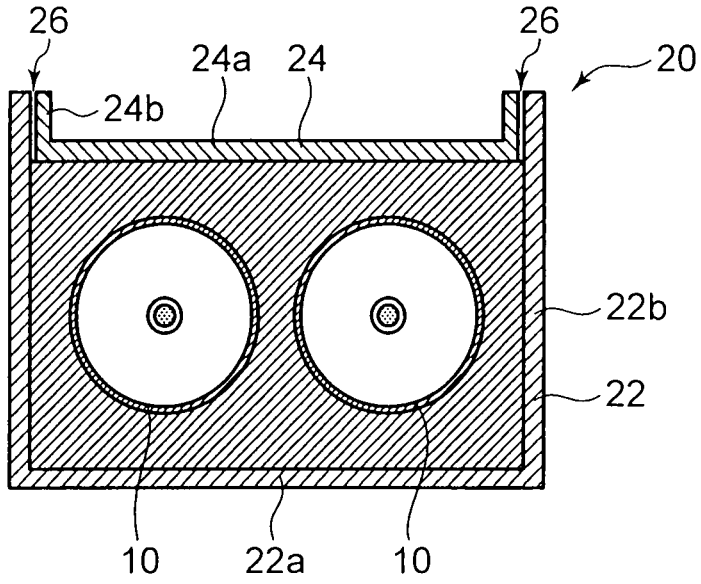
FIG. 5 is a cross-sectional view taken along a V-V line in FIG. 4.

The container 20 is for housing at least the blasting explosive 30 therein. FIG. 3 is a schematic exploded view of the container 20. FIGS. 4 and 5 are cross-sectional views showing a state where the chemical bomb 10 is housed in the container 20.

The container 20 has a main body portion 22 and a lid portion 24 as shown in FIG. 3. In the first embodiment, as shown in FIG. 4 and the like, the blasting explosive 30 and two of the chemical bombs 10 are housed in the container 20.

The main body portion 22 of the container 20 is a box-shaped member having an opening portion 22*c* that opens upward. The main body portion 22 has a bottom wall 22*a* and side walls 22*b*. The bottom wall 22*a* of the main body portion 22 is a rectangular board-shaped member. The side walls 22*b* of the main body portion 22 stand upward from the perimeter of the bottom wall 22*a* of the main body portion 22. The chemical bombs 10 and the blasting explosive 30 are housed in a room enclosed with the bottom wall 22*a* and the side walls 22*b* of the main body portion 22. A through-hole 22*d* penetrating the wall in the thickness direction is formed on the wall standing up from an end in the longitudinal direction of the main body portion 22 among the side walls 22*b* of the main body portion 22.

The lid portion 24 has a shape capable of covering a part of the opening portion 22*c* of the main body portion 22. Specifically, the lid portion 24 has a bottom wall 24*a* and side walls 24*b*. The bottom wall 24*a* of the lid portion 24 is a rectangular board-shaped member. The side walls 24*b* of the lid portion 24 stand upward from the perimeter of the bottom wall 24*a* of the lid portion 24. The lid portion 24 is a so-called drop-lid. The lid portion 24 has the bottom wall 24*a* of the lid portion 24 parallel with the bottom wall 22*a* of the main body portion 22, and has a shape that is dropped inside the main body portion 22 from the opening portion 22*c* of the main body portion 22 in a state where a specified gap is formed between outer surfaces of the side walls 24*b* of the lid portion 24 and inner surfaces of the side walls 22*b* of the main body portion 22. A length B1 in a longitudinal direction of the lid portion 24 is shorter than a length A1 in a longitudinal direction of the opening portion 22*c* of the main body portion 22. A length B2 in a width direction of the lid portion 24 is shorter than a length A2 in a width direction of the opening portion 22*c*.

As shown in FIG. 2 and the like, when the lid portion 24 is in a state of being dropped inside the main body portion 22, a gap 26 communicating between the inside and outside of the container 20 is formed between the outer surfaces of the side walls 24*b* of the lid portion 24 and the inner surfaces of the side walls 22*b* of the main body portion 22. The gap 26 has a size regulating the escape of the blasting explosive 30 to the outside of the container 20 while permitting the escape of gases inside the container 20 to the outside. In other words, the lengths B1 and B2 of the lid portion 24 and the lengths A1 and A2 of the opening portion 22*c* of the main body portion 22 are set to dimensions that form a gap having the above-mentioned size between the outer surfaces of the side walls 24*b* of the lid portion 24 and the inner surfaces of the side walls 22*b* of the main body portion 22.

The materials of the main body portion 22 and the lid portion 24 of the container 20 are not particularly limited. However, it is preferable that these main body portion 22 and lid portion 24 of the container 20 be able to be blasted out together with the chemical bomb 10 and the like. In addition, it is preferable that these main body portion 22 and lid portion 24 of the container 20 be light-weighted and have a little amount of gases generated at the time of explosion. In this embodiment, the main body portion 22 and the lid portion 24 are made of wood, respectively.

The detonator 50 is for initiating the booster explosive 40. In the first embodiment, the detonator 50 is an electric detonator. A lead wire 52 for connecting the detonator 50 to a blasting machine 80 to be described later is attached to the detonator 50.

The chamber 60 has a shape capable of housing the entire container 20. Blast treatment of the chemical bomb 10 is carried out inside the chamber 60. The chamber 60 has an explosion-proof structure, and is firmly configured with structural material such as iron. The chamber 60 can withstand explosion pressure generated at the time of blast treatment. Furthermore, the chamber 60 can prevent hazardous substances and the like, which are generated at the time of blast treatment, from leaking to the outside of the chamber 60 in a state where the inside of the chamber 60 is sealed.

The chamber 60 has a chamber main body portion 62 and a chamber lid portion 64. The chamber main body portion 62 has an approximately cylindrical shape, and an end thereof in the axis direction opens outward. The chamber lid portion 64 covers the opening portion of the chamber main body portion 62 in a manner of openable and closable. The chamber lid portion 64 can be detached from and attached to the chamber main body portion 62. The inside of the chamber 60 is sealed by the chamber lid portion 64 covering the opening portion of the chamber main body portion 62. A communicating portion 62*a* communicating between the inside and outside of the chamber main body portion 62 is formed at an end opposite to the opening portion in the chamber main body portion 62.

The vacuum pump 70 is for decompressing the inside of the chamber 60 and making the inside of the chamber 60 almost vacuous. The vacuum pump 70 sucks and leads out gases inside the chamber 60 through the communicating portion 62*a* of the chamber 60.

The blast treatment method using the blast treatment device 1 includes the following steps.

1) Blasting Preparation Step

This step is for installing the chemical bombs 10, the blasting explosive 30, the booster explosive 40, and the detonator 50 on their respective positions.

Firstly, a tube 54 is inserted into the through-hole 22*d* formed on the container 20. The tube 54 is for housing a part of the booster explosive 40. Specifically, the tube 54 protrudes outward from the side wall 22*b* of the main body portion 22 of the container 20, and is inserted into the through-hole 22*d* in a manner of bringing an outer circumference surface of the tube 54 into intimate contact with an inner circumference surface of the through-hole 22*d*. The material of the tube 54 is not particularly limited. In the embodiment, the tube 54 is made of polyvinyl chloride.

Next, the booster explosive 40 is placed inside the tube 54 and inside the main body portion 22 of the container 20. Specifically, a part of the booster explosive 40 is attached to the inner surface of the side wall 22*b* of the main body portion 22 in a state of covering the through-hole 22*d*. The rest of the booster explosive 40 is then inserted into the tube 54 in a state of contacting with the part of the booster explosive 40 attached to the inner surface of the side wall 22*b* of the main body portion 22. In this manner, the booster explosive 40 is attached to the side wall 22*b* of the main body portion 22 of the container 20 in a state of communicating between the inside and outside of the container 20.

Next, the detonator 50 is placed. The detonator 50 is inserted into the tube 54 in a manner of contacting an end of the detonator 50 with the booster explosive 40. At this point, the lead wire 52 previously connected to the detonator 50 is led out to the outside of the tube 54.

Next, the chemical bombs 10 are housed in the main body portion 22 of the container 20. Here, as described above, the two chemical bombs 10 are housed in the same container 20 in order to treat the two chemical bombs 10 simultaneously. At this point, the chemical bombs 10 are placed in a manner of making the axis direction of the chemical bombs 10 parallel with the longitudinal direction of the container 20 as shown in FIGS. 4 and 5. Moreover, the chemical bombs 10 are placed in parallel with each other in a manner of spacing them at a specified distance in the horizontal direction.

Next, the blasting explosive 30 is poured into the main body portion 22 of the container 20 from the opening portion 22*c* of the main body portion 22. The blasting explosive 30 has fluidity as described above. Therefore, the blasting explosive 30 can enter between the chemical bombs 10 and the inner surface of the main body portion 22 of the container 20. Hence, the blasting explosive 30 covers the periphery of these chemical bombs 10 in intimate contact with the chemical bombs 10.

Especially, in the first embodiment, it is possible for the blasting explosive 30 to easily enter between the two chemical bombs 10 housed in the main body portion 22 of the container 20. Accordingly, sufficient amounts of the blasting explosive 30 are placed around the periphery of the chemical bombs 10, respectively. In the first embodiment, the blasting explosive 30 is poured into the container 20 to a point that covers over the chemical bombs 10, and is placed around the entire periphery of the chemical bombs 10. At this point, the blasting explosive 30 is in intimate contact with the part of the booster explosive 40 attached to the inner surface of the side wall 22*b* of the main body portion 22 of the container 20.

The present invention is not limited to a method that the blasting explosive 30 is poured after the chemical bombs 10 are housed in the main body portion 22 of the container 20, as described above. For example, a part of the blasting explosive 30 may be poured into the main body portion 22 of the container 20, and then, the chemical bombs 10 may be housed in the main body portion 22, and afterward, the rest of the blasting explosive 30 may be poured into the main body portion 22.

Next, the lid portion 24 of the container 20 is mounted on the blasting explosive 30 placed in the main body portion 22 of the container 20. At this point, a bottom surface of the bottom wall 24*a* of the lid portion 24 is in intimate contact with a top surface of the blasting explosive 30, and the side walls 24*b* of the lid portion 24 stand upward from the bottom wall 24*a*. In this state, the gap 26 located above the blasting explosive 30 is formed between the outer surfaces of the side walls 24*b* of the lid portion 24 and the inner surfaces of the side walls 22*b* of the main body portion 22. The gap 26 is a gas vent portion according to the present invention. The blasting explosive 30 is brought by the weight of the lid portion 24 into intimate contact with the chemical bombs 10.

2) Housing Step

This step is for housing in the chamber 60 the container 20 in which the chemical bombs 10, the blasting explosive 30, the booster explosive 40, the detonator 50, and the like are attached.

As shown in FIG. 2 and the like, support stands 63 are previously installed on the bottom of the chamber main body portion 62. The container 20 is installed on the support stands 63. At this point, the lid portion 24 of the container 20 is located on the upper side. The opening portion of the chamber main body portion 62 is covered by the chamber lid portion 64 afterward, and the chamber 60 is sealed. At this point, the lead wire 52 is drawn out to the outside of the chamber 60. The blasting machine 80 is attached to the lead wire 52.

Incidentally, the container 20 may be hung down from an upper part of the chamber main body portion 62 with a rope or the like in an attitude where the lid portion 24 is on the upper side.

The housing step may be taken before the blasting preparation step. Specifically, a housing operation of housing the chemical bombs 10, and the blasting explosive 30 in the container 20 and an attaching operation of attaching the booster explosive 40, the detonator 50, and the like to the container 20 and the like may be performed in a state where the container 20 is housed in the chamber 60.

3) Decompression Step

This step is for decompressing the inside of the chamber 60.

In this step, the vacuum pump 70 is driven. The vacuum pump 70 sucks out gases in the chamber 60 to the outside. The pressure in the chamber 60 decreases due to the suction. At this point, gases such as air included in the blasting explosive 30 is separated from the blasting explosive 30 as air bubbles.

Here, supposing that the inside of the container 20 is completely sealed, the internal pressure of the container 20 relatively increases following the decrease in the pressure outside the container 20. In other words, the gases including the air bubbles in the container 20 expand. The increase in the internal pressure of the container 20 may expand and deform the container 20. Moreover, the deformation may hamper the initiation after the decompression step. For example, the deformation of the container 20 may widen the diameter of the through-hole 22*d* of the container 20 and pull out the tube 54 inserted into the through-hole 22*a* and the detonator 50 inserted into the tube 54 from the container 20. Furthermore, the deformation of the container 20 may separate the blasting explosive 30 from the booster explosive 40 attached to the side wall 22*b* of the main body portion 22 of the container 20.

However, in the method according to the first embodiment, the gap 26 being a gas vent portion is formed in the container 20. Therefore, regardless of the decrease in the pressure in the chamber 60, the gases in the container 20 can escape from the gap 26 to the outside without deforming the container 20. Consequently, in contrast with a case the gases are sealed in the container 20, the deformation of the container 20 caused by the relative increase in the internal pressure of the container 20 is effectively deterred. This will prevent the positions of the detonator 50 and the booster explosive 40 from deviating. Additionally, the gap 26 has a size regulating the passage of the blasting explosive 30. Hence, only the gases in the container 20 are efficiently discharged to the outside without the blasting explosive 30 leaking to the outside of the container 20.

When the gases included in the blasting explosive 30 are discharged to the outside of the container 20, the volume of the blasting explosive 30 decreases and the top surface of the blasting explosive 30 becomes low. The lid portion 24 of the container 20 is simply mounted on the top surface of the blasting explosive 30, and falls following the fall of the position of the top surface of the blasting explosive 30. Accordingly, regardless of the fall of the position of the top surface of the blasting explosive 30, the top surface of the blasting explosive 30 and the lid portion 24 are maintained in intimate contact with each other. Furthermore, the blasting explosive 30 and the chemical bombs 10 are maintained in intimate contact with each other by the lid portion 24 pressing the blasting explosive 30.

4) Blasting Step

This step is for blasting the chemical bombs 10.

In this step, firstly, the blasting machine 80 is operated, and the detonator 50 initiates the booster explosive 40. The position of the detonator 50 is prevented from deviating in the decompression step, and the detonator 50 securely initiates the booster explosive 40. Then, the booster explosive 40 securely blasts the chemical bombs 10.

Specifically, the booster explosive 40 is initiated to start the detonation. The detonation energy of the booster explosive 40 initiates the blasting explosive 30. More specifically, firstly, the detonation energy of the booster explosive 40 initiates a part of the blasting explosive 30, which is placed in the end in the longitudinal direction of the container 20 and is in intimate contact with the booster explosive 40. The rest of the blasting explosive 30 is initiated sequentially along the longitudinal direction of the container 20 afterward. At this point, since the deviation from the position of the booster explosive 40 is deterred, the booster explosive 40 securely initiates the blasting explosive 30.

The explosion energy of the blasting explosive 30 destroys the bomb shells 11 of the chemical bombs 10, respectively, and initiates the bursting charge 12 embedded in each of the chemical bombs 10. The blasting explosive 30 is maintained in intimate contact with the chemical bombs 10 due to the weight of the lid portion 24. Therefore, the explosion energy of the blasting explosive 30 efficiently acts on the chemical bombs 10.

The initiated bursting charges 12 release the explosion energy in a manner of dispersing fragments and the like of the bomb shells 11 outward. The explosion energy of the bursting charges 12 attempts to disperse the fragments of the bomb shells 11 and the chemical agents 13 embedded in the bomb shells 11 outward. However, the explosion energy of the blasting explosive 30 initiated before the bursting charges 12 is generated around the periphery of the chemical bombs 10. The explosion energy of the blasting explosive 30 controls the outward dispersion of the fragments of the bomb shells 11 and the chemical agents 13.

The blasting step is taken in a state where the chamber 60 has been decompressed. Therefore, while the blast treatment of the chemical bombs 10 is carried out, the chemical agents 13 and the like are controlled to leak to the outside, and the environmental impacts of sound, vibration, and the like due to the blast treatment decrease.

Incidentally, the explosion energy of the blasting explosive 30 blasts the container 20, too, in the blasting step according to the first embodiment.

As described above, in the blast treatment method according to the first embodiment, since the gases in the container 20 escape to the outside of the container 20 through the gap 26 in the decompression step, the deformation of the container 20 due to the relative increase in the internal pressure of the container 20 is prevented. The prevention of the deformation of the container 20 effectively deters deviations from the positions of the detonator 50, the booster explosive 40, and the like, and by extension the failed detonation of the blasting explosive 30. This realizes the secure blast treatment of the chemical bombs 10 in the sealed chamber 60 by using the fluid blasting explosive 30 that can be readily placed around the periphery of the chemical bombs 10. The realization of blasting in the sealed chamber 60 decreases the environmental impacts of sound, vibration, and the like, by the blast treatment of the chemical bombs 10.

Furthermore, in the first embodiment, the lid portion 24 of the container 20 falls following the fall of the position of the top surface of the blasting explosive 30 in the decompression step. This ensures the blast treatment of the chemical bombs 10 by maintaining the blasting explosive 30 in intimate contact with the chemical bombs 10 while preventing the deformation of the container 20.

The structure to cause the lid portion 24 of the container 20 to follow the fall of the top surface of the blasting explosive 30 is not limited to the above. For example, a rail extending upward and downward may be provided for any one of the lid portion 24 and the main body portion 22 of the container 20, and a member capable of sliding on the rail may be attached to the other. However, as described above, the structure in which the lid portion 24 of the container 20 is simply mounted on the top surface of the blasting explosive 30 does not need a complicated mechanism. This simplifies the structure of the container 20, an installation operation of the lid portion 24, and the like.

In addition, the gas vent portion according to the present invention is not limited to the gap 26 formed between the outer surface of the lid portion 24 of the container 20 and the main body portion 22 of the container 20, similarly to the above. For example, instead of the gap 26, a small-diameter hole communicating between the inside and outside of the lid portion 24 or main body portion 22 of the container 20 may be formed and the diameter may be set to regulate the escape of the blasting explosive 30. However, the structure in which the gap 26 between the lid portion 24 and the main body portion 22 of the container 20 functions as the gas vent portion simplifies the structure of the container 20.

Next, a description will be given of a second embodiment of the blast treatment method according to the present invention with reference to FIG. 6.

Figure 6:
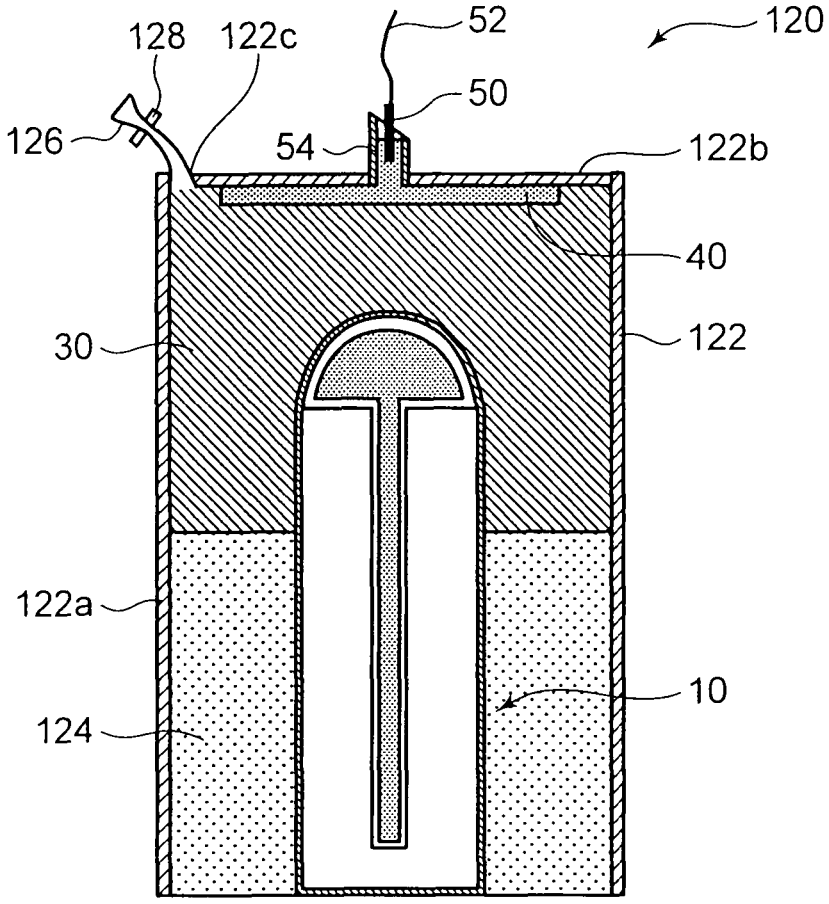
FIG. 6 is a cross-sectional view showing a state where a treatment subject is housed in a container used in a blast treatment method according to a second embodiment of the present invention.

A container 120 shown in FIG. 6 is used in the second embodiment. The chemical bomb 10 is housed in the container 120. Incidentally, in FIG. 6, the same reference numerals are given to elements having the same structures as those of the blast treatment device 1 according to the first embodiment, and the detailed description will be omitted.

The container 120 according to the second embodiment has external boards 122, a sponge 124, and a communicating pipe 126.

The external boards 122 are sheet-shaped members for enclosing the chemical bomb 10. The external boards 122 are boards made of polyethylene, for example. The external boards 122 have side walls 122*a* enclosing the side of the chemical bomb 10 from the outside in the diameter direction, and a top wall 122*b* covering a top surface of the chemical bomb 10 connected to the side walls 122*a*.

The sponge 124 is housed in a lower region of a space enclosed by the external board 122. The blasting bomb 30 is housed in an upper region of a space enclosed by the external boards 122, in other words, in a region over the sponge 124.

The communicating pipe 126 is attached to the external boards 122. The communicating pipe 126 is for discharging gases generated in a space enclosed by the external boards 122 and the sponge 124 to the outside of the space, and functions as a gas vent portion of the present invention. The communicating pipe 126 is made of polyvinyl chloride, for example. The outside shape of the top wall 122*b* of the external board 122 is set to be smaller than a shape of a part enclosed by the side walls 122*a* of the external boards 122. In a state where the top wall 122*b* of the external board 122 is connected to the side walls 122*a* of the external boards 122, a communicating portion 122*c* communicating between the inside and outside of the external boards 122 is formed between an outer edge of the top wall 122*b* and the side walls 122*a*. The communicating pipe 126 extends from the communicating portion 122*c* to the outside of the space enclosed by the side walls 122*a* and top wall 122*b* of the external board 122.

A description will be given of the blast treatment method according to the second embodiment using the container 120. In this method, a detailed description will be omitted of parts common to the blast treatment method according to the first embodiment.

1) Blasting Preparation Method

In the blasting preparation method, firstly, the side walls 122*a* of the external boards 122 are placed in a manner of enclosing the periphery of the chemical bomb 10. Moreover, the sponge 124 is placed in a manner of covering the periphery of an almost lower half of the chemical bomb 10 from the side between the side walls 122*a* of the external boards 122 and the chemical bomb 10.

Next, the blasting explosive 30 is filled to a part enclosed by the side walls 122*a* of the external boards 122 through the communicating pipe 126. The blasting explosive 30 is filled to the height of the top wall 122*b* of the external board 122. The blasting explosive 30 is placed around the periphery of the chemical bomb 10 at least over the sponge 124.

Next, the top wall 122*b* is connected to the side walls 122*a* of the external boards 122. The tube 54 and the booster explosive 40 are previously attached to the top wall 122*b*. The top wall 122*b* is connected to the side walls 122*a* in intimate contact with the top surface of the blasting explosive 30.

Next, a throttle member 128 throttles at least a part of a channel area of the communicating pipe 126. The channel area is set to be an area that permits the passage of gases while regulating the passage of the blasting explosive 30. An adhesive tape or the like capable of being wrapped around the communicating pipe 126 is suitable as the throttle member 128, for example.

Incidentally, the communicating pipe 126 may be omitted to cause a part of a bag made of vinyl or the like housed in the side walls 122*a* of the external boards 122 to function as the gas vent portion. In other words, the chemical bomb 10 is placed in the bag, the bag is spread in intimate contact with the inside of the side walls 122*a*, and the blasting explosive 30 is filled therein. The top wall 122*b* of the external board 122 is installed in intimate contact with the top surface of the bag afterward. The bag is then drawn out from communicating portion 122*c* to the outside of the external boards 122 to communicate between the inside and outside of the side walls 122*a*. In this state, a mouth of the bag may be throttled with the throttle member 128. With this setting, it is possible to readily form the gas vent portion.

2) Housing Step/Decompression Step/Blasting Step

These steps are taken similarly to those of the first embodiment. In the second embodiment, too, the communicating pipe 126 permits the escape of gases in the container 120 upon decompression of the container 120. This effectively deters the expansion and deformation of the container 120 and prevents deviations from the positions of the detonator 50 and the like.

The gas vent portion according to the second embodiment is formed with a simple procedure of adjusting the channel area of the communicating pipe 126 with the throttle member 128. The procedure makes it possible to readily adapt to a type of the blasting explosive 30, and increases the convenience.

Here, the specific number and shape of the treatment subject are not limited. In the present invention, a blasting explosive having fluidity is used. The use of the fluid blasting explosive makes it possible to readily place the blasting explosive around the periphery of the treatment subject regardless of the type, number and shape of the treatment subject. The present invention especially exerts an excellent effect of more securely carrying out the blast treatment of the treatment subject while reducing time and power to place an explosive, by being applied to the simultaneous blast treatment of a plurality of treatment subjects and the blast treatment of a plurality of treatment subjects having different shapes from each other.

The types of the blasting explosive 30 and the booster explosive 40 are not limited. The booster explosive 40 can be omitted. However, the step of causing the explosion energy of the booster explosive 40 provided between the blasting explosive 30 and the detonator 50 to invite the initiation of the blasting explosive 30 makes the initiation of the blasting explosive 30 easier than a step of causing the detonator 50 to directly initiate the blasting explosive 30.

Figure 7:
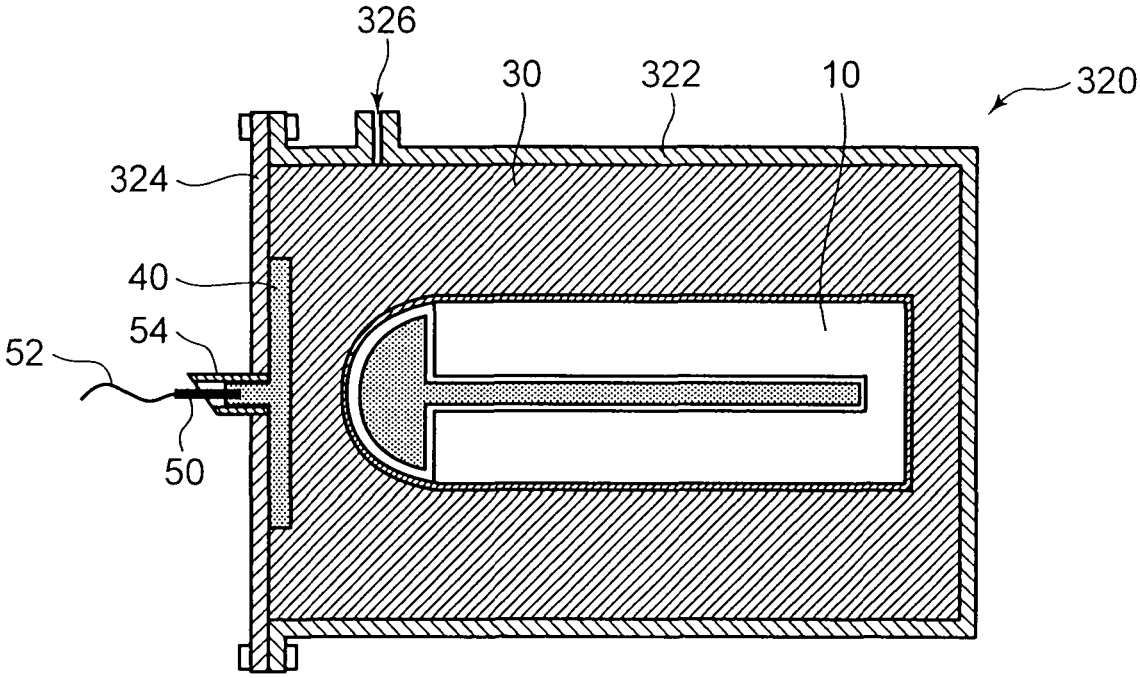
FIG. 7 is a cross-sectional view showing another example of a container used in the blast treatment method of the present invention.

A specific structure of the container is not limited to the above. The container may be a container 320 shown in FIG. 7, for example. The container 320 has a main body portion 322 and the lid portion 324 attached to the main body portion 322 in a manner of being unable to be displaced. The main body portion 322 of the container 320 has a gas vent portion 326 whose channel area is invariant. The gas vent portion 326 has a shape that gases in the container 320 can escape to the outside through the gas vent portion 326 while the escape of the blasting explosive 30 is regulated.

However, the container 30 having the lid portion 24 that can be displaced together with the top surface of the blasting explosive 30 as in the first embodiment maintains the blasting explosive 30 in intimate contact with the chemical bomb 10 by use of the own weight of the lid portion 24. Therefore, the blast treatment of the chemical bomb 10 is more secured. Moreover, one capable of adjusting a channel area thereof similarly to the communicating pipe 126 according to the second embodiment makes it possible to readily adapt to the type of the blasting explosive 30 and improve the convenience.

As described above, the present invention provides a blast treatment method for carrying out the blast treatment of a treatment subject, including: a blasting preparation step of housing a blasting explosive having fluidity in a container and placing the blasting explosive around the periphery of the treatment subject as well as attaching a initiation device to the container; a housing step of housing the container, the blasting explosive, and the treatment subject in the chamber; a decompression step of decompressing the inside of the chamber in a state where the chamber is sealed after the housing step; and a blasting step of initiating the blasting explosive by the initiation device and blasting the treatment subject by the blasting explosive, wherein the blasting preparation step includes the steps of: providing the container with a gas vent portion that regulates escape of the blasting explosive from the container while permitting escape of gases in the container; and hermetically sealing parts except the gas vent portion of the container, and in the decompression step, the inside of the container is decompressed through the gas vent portion while the inside of the chamber is decompressed.

In this method, the inside of the chamber is decompressed in a state where the escape of the blasting explosive to the outside of the container is regulated while the escape of the gases in the container to the outside of the container through the gas vent portion is permitted. Therefore, the internal pressure of the container relatively increases in relation to the pressure outside the container due to the gases included in the blasting explosive having fluidity, and the deformation of the container is controlled. This realizes the secure blast treatment of a treatment subject in a sealed chamber whose inside is decompressed while using a blasting explosive having fluidity. The use of the blasting explosive having fluidity makes it easy to place the blasting explosive around the periphery of a treatment subject regardless of the shape of the treatment subject. The blast treatment in the sealed chamber whose inside is decompressed makes the environmental impacts of sound, vibration, and the like upon blasting excellent.

In the present invention, it is preferable that the container include an opening portion that permits the admission of the blasting explosive to the container, that the blasting preparation step include a step of closing the opening portion while leaving a gap of a size that regulates the passage of the blasting explosive and permits the passage of the gases in the container, after admitting the blasting explosive to the container from the opening portion, and that in the decompression step, the gap be caused to function as the gas vent portion, and the gases in the container be discharged to the outside of the container through the gap while the inside of the chamber is decompressed.

In this manner, the opening portion for placing the blasting explosive in the container is effectively used, and the gas vent portion is constructed readily and with a simple structure.

Moreover, in the present invention, it is preferable that the container include a main body portion where an opening portion opening upward is formed, and a lid portion having a shape that covers at least a part of the opening portion, that the blasting preparation step include the steps of: housing the blasting explosive in the main body portion of the container; and mounting the lid portion on the blasting explosive housed in the main body portion in a manner that the lid portion falls following a fall of the position of the top surface of the blasting explosive, and that in the decompression step, the inside of the chamber be decompressed while accompanying the falls of the position of the top surface of the blasting explosive and the lid portion.

In this method, even if the position of the top surface of the blasting explosive falls due to a decrease in an apparent volume of the blasting explosive following the discharge of gases from the container, the lid portion falls following this. Therefore, even after the decompression of the inside of the chamber, the lid portion maintains the blasting explosive in highly intimate contact with a treatment subject by its own weight. This increases the efficiency of propagation to the treatment subject of explosion energy of the blasting explosive. Furthermore, it is sufficient as long as the lid portion is mounted on the blasting explosive. Accordingly, the operation efficiency is high.

Here, it is preferable that the blasting preparation step include a step of forming a gap with a dimension that regulates the passage of the blasting explosive and permits the escape of the gases between an outer surface of the lid portion and an inner surface of the main body portion enclosing the opening portion while mounting the lid portion on the blasting explosive in the main body portion, and that in the decompression step, the gases in the container be discharged to the outside of the container through the gap functioning as the gas vent portion while the inside of the chamber is decompressed. In this manner, with a simple method where the lid portion is mounted on the blasting explosive, it is possible to readily form a gap constituting the gas vent portion.

Additionally, in the present invention, it is preferable that the blasting explosive and the treatment subject be placed in the container in a manner that the blasting explosive covers the periphery of the treatment subject in the blasting explosive placement step.

In this manner, the blasting explosive is readily placed around the periphery of the treatment subject, and the operations in the blasting explosive placement step are facilitated.

In addition, in the present invention, it is preferable that the blasting preparation step include a step of placing a booster explosive made of an explosive having higher sensitivity to initiation than the blasting explosive between the blasting explosive and the initiation device, and that the blasting step include initiating the booster explosive with the initiation device and initiating the blasting explosive by explosion energy of the booster explosive.

In this method, the booster explosive to be initiated with relative ease is initiated with the initiation device, and the explosion energy of the booster explosive initiates the blasting explosive. Therefore, it is made easier to initiate the blasting explosive than a case where the initiation device directly initiates the blasting explosive.

The present invention can more securely carry out the blast treatment of a plurality of treatment subjects while using a blasting explosive having fluidity readily placed around the periphery of the treatment subjects. Hence, when the blast treatment of a plurality of treatment subjects, which are relatively difficult to place a blasting explosive, are simultaneously carried out, it is more effective if the present invention is used. In this case, it is sufficient if the blasting explosive is placed around the peripheries of a plurality of the treatment subjects in the blasting explosive placement step, and the blast treatment of the plurality of treatment subjects is simultaneously carried out in the blasting step.

Moreover, the present invention provides a blast treatment device for carrying out blasting the treatment of a treatment subject, including: a blasting explosive having fluidity for blasting the treatment subject; a container capable of housing the blasting explosive; a chamber capable of being sealed in a state of housing the blasting explosive and the treatment subject therein; a decompression device for decompressing the inside of the chamber; and a initiation device attached to the container and used for initiating the blasting explosive, wherein the blasting explosive is placed around the periphery of the treatment subject in a state of being housed in the container, and the container has a gas vent portion for regulating the escape of the blasting explosive housed in the container to the outside of the container and permitting the escape of gases in the container to the outside of the container.

In this apparatus, the gas vent portion of the container deters the deformation of the container caused by a relative increase in the internal pressure of the container, and by extension a deviation from the position of the initiation device, by regulating the escape of the blasting explosive from the container and permitting the escape of the gases in the container to the outside. This facilitates the placement of the blasting explosive accompanied by the use of the blasting explosive having fluidity as well as ensures the initiation of the blasting explosive in the hermetically sealed chamber whose inside is decompressed and ensures the blast treatment of the treatment subject while making the environmental impacts of sound, vibration, and the like upon blasting excellent.

In this apparatus, it is preferable that the container include: a main body portion having an opening portion that permits the admission of the blasting explosive to the container; and a closing member capable of forming the gas vent portion in the opening portion by closing the opening portion while leaving a gap of a size that regulates the passage of the blasting explosive and permits the passage of the gases in the container.

In this manner, the vast vent portion is constructed readily and with a simple structure by use of the opening portion for placing the blasting explosive in the container.

Furthermore, it is preferable that the container include: a main body portion having an opening portion that permits the admission of the blasting explosive while being placed in a manner that the opening portion opens upward; and a lid portion having a shape that covers at least a part of the opening portion of the main body portion, and that the lid portion be mounted on a top surface of the blasting explosive housed in the main body portion and be capable of falling following a fall of a position of the top surface of the blasting explosive.

In this manner, the weight of the lid portion increases intimate contact between the blasting explosive and the treatment subject. Especially, even if the position of the top surface of the blasting explosive falls following a decrease in the apparent volume of the blasting explosive due to the decompression in the chamber, the lid portion falls following this. Consequently, the effect of an improvement in intimate contact between the blasting explosive and the treatment subject due to the lid portion is maintained upon decompression, too. This increases the propagation efficiency of explosion energy from the blasting explosive to the treatment subject.

Moreover, it is preferable that the lid portion have an outer surface that can form, with an inner surface of the main body portion enclosing the opening portion, a gap regulating passage of the blasting explosive and permitting passage of the gases.

In this manner, a suitable gas vent portion is readily constructed with a simple structure where the lid portion is simply mounted on the blasting explosive housed in the main body portion.

Furthermore, it is preferable that the blasting explosive be placed in the container in a manner of covering the periphery of the treatment subject.

In this manner, the treatment subject is more securely blasted by concentrating the explosion energy of the blasting explosive on the treatment subject.

Additionally, it is preferable to include a booster explosive made of an explosive having higher sensitivity to initiation than the blasting explosive, and to place the booster explosive in a position that can be initiated by the initiation device and can initiate the blasting explosive by the explosion energy of the booster explosive, the position being between the initiation device and the blasting explosive.

In this manner, the booster explosive initiates the blasting explosive more readily than a case where the initiation device directly initiates the blasting explosive.

The invention claimed is:

1. A blast treatment method for carrying out blast treatment of a treatment subject, comprising:

a blasting preparation step of housing a blasting explosive having fluidity in a container and placing the blasting explosive around a periphery of the treatment subject as well as attaching an initiation device to the container;

a housing step of housing the container, the blasting explosive, and the treatment subject in a chamber;

a decompression step of decompressing an inside of the chamber in a state where the chamber is sealed after the housing step; and a blasting step of initiating the blasting explosive by the initiation device and blasting the treatment subject by the blasting explosive, wherein the blasting preparation step includes the steps of: providing the container with a gas vent portion that regulates escape of the blasting explosive from the container while permitting escape of gases in the container; and hermetically sealing parts except the gas vent portion of the container, and in the decompression step, an inside of the container is decompressed through the gas vent portion while the inside of the chamber is decompressed.

2. The blast treatment method according to claim 1, wherein the container includes an opening portion that permits admission of the blasting explosive to the container, the blasting preparation step includes a step of closing the opening portion while leaving a gap of a size that regulates passage of the blasting explosive and permits passage of the gases in the container, after admitting the blasting explosive to the container from the opening portion, and in the decompression step, the gap is caused to function as the gas vent portion and the gases in the container are discharged to the outside of the container through the gap while the inside of the chamber is decompressed.

3. The blast treatment method according to claim 1, wherein the container includes a main body portion where an opening portion opening upward is formed, and a lid portion having a shape that covers at least a part of the opening portion, the blasting preparation step includes the steps of: housing the blasting explosive in the main body portion of the container; and mounting the lid portion on the blasting explosive housed in the main body portion in a manner that the lid portion falls following a fall of a position of a top surface of the blasting explosive, and in the decompression step, the inside of the chamber is decompressed while accompanying the falls of the position of the top surface of the blasting explosive and the lid portion.

4. The blast treatment method according to claim 3, wherein the blasting preparation step includes a step of forming a gap with a dimension that regulates passage of the blasting explosive and permits escape of the gases between an outer surface of the lid portion and an inner surface of the main body portion enclosing the opening portion while mounting the lid portion on the blasting explosive in the main body portion, and in the decompression step, the gases in the container are discharged to the outside of the container through the gap functioning as the gas vent portion while the inside of the chamber is decompressed.

5. The blast treatment method according to claim 1, wherein the blasting explosive and the treatment subject are placed in the container in a manner that the blasting explosive covers a periphery of the treatment subject in the blasting explosive placement step.

6. The blast treatment method according to claim 1, wherein the blasting preparation step includes a step of placing a booster explosive made of an explosive having higher sensitivity to initiation than the blasting explosive between the blasting explosive and the initiation device, and the blasting step includes initiating the booster explosive with the initiation device and initiating the blasting explosive by explosion energy of the booster explosive.

7. The blast treatment method according to claim 1, wherein the blasting explosive is placed around peripheries of a plurality of the treatment subjects in the blasting explosive placement step, and blast treatment of the plurality of treatment subjects is simultaneously carried out in the blasting step.

8. A blast treatment device for carrying out blast treatment of a treatment subject, comprising:

a blasting explosive having fluidity for blasting the treatment subject;

a container capable of housing the blasting explosive;

a chamber capable of being sealed in a state of housing the blasting explosive and the treatment subject therein;

a decompression device for decompressing an inside of the chamber; and a initiation device attached to the container and used for initiating the blasting explosive, wherein the blasting explosive is placed around a periphery of the treatment subject in a state of being housed in the container, and the container has a gas vent portion for regulating escape of the blasting explosive housed in the container to an outside of the container and permitting escape of gases in the container to the outside of the container.

9. The blast treatment device according to claim 8, wherein the container includes: a main body portion having an opening portion that permits admission of the blasting explosive to the container; and a closing member capable of forming the gas vent portion in the opening portion by closing the opening portion while leaving a gap of a size that regulates passage of the blasting explosive and permits passage of the gases in the container.

10. The blast treatment device according to claim 8, wherein the container includes: a main body portion having an opening portion that permits admission of the blasting explosive while being placed in a manner that the opening portion opens upward; and a lid portion having a shape that covers at least a part of the opening portion of the main body portion, and the lid portion is mounted on a top surface of the blasting explosive housed in the main body portion and is capable of falling following a fall of a position of the top surface of the blasting explosive.

11. The blast treatment device according to claim 10, wherein the lid portion has an outer surface that can form, with an inner surface of the main body portion enclosing the opening portion, a gap regulating passage of the blasting explosive and permitting passage of the gases.

12. The blast treatment device according to claim 8, wherein the blasting explosive is placed in the container in a manner of covering a periphery of the treatment subject.

13. The blast treatment device according to claim 8, further comprising a booster explosive made of an explosive having higher sensitivity to initiation than the blasting explosive, wherein the booster explosive is placed in a position that can be initiated by the initiation device and can initiate the blasting explosive by explosion energy of the booster explosive, the position being between the initiation device and the blasting explosive.

* * * * *